US007028446B2

(12) United States Patent
Winchester

(10) Patent No.: US 7,028,446 B2
(45) Date of Patent: Apr. 18, 2006

(54) CONSTRUCTION LAYOUT STRIPPING HAVING A PLURALITY OF PAIRS OF UPRIGHTS THEREON

(76) Inventor: Richard M. Winchester, 16579 Clayton Rd., Wildwood, MO (US) 63011

( * ) Notice: Subject to any disclaimer, the term of this patent is extended or adjusted under 35 U.S.C. 154(b) by 74 days.

(21) Appl. No.: 09/940,208

(22) Filed: Aug. 27, 2001

(65) Prior Publication Data

US 2002/0023402 A1 Feb. 28, 2002

Related U.S. Application Data

(63) Continuation-in-part of application No. 09/356,300, filed on Jul. 16, 1999, now abandoned.

(51) Int. Cl.
*E04G 21/16* (2006.01)

(52) U.S. Cl. ..... 52/746.1; 52/745.05; 52/105

(58) Field of Classification Search ..... 52/745.05, 52/745.1, 746.1, 749.1, 105, DIG. 1; 33/613, 33/645, 562, 755, 758, 759
See application file for complete search history.

(56) References Cited

U.S. PATENT DOCUMENTS

| | | | | | |
|---|---|---|---|---|---|
| 2,466,919 | A | * | 4/1949 | Sykes | 33/526 |
| 2,567,586 | A | * | 9/1951 | Werder | 33/562 |
| 2,991,857 | A | * | 7/1961 | Soderberg | 52/750 |
| 3,169,320 | A | * | 2/1965 | Currie | 33/429 |
| 3,210,850 | A | * | 10/1965 | Gryzb | 33/758 |
| 3,922,464 | A | * | 11/1975 | Silver et al. | 428/355 AC |
| 3,945,630 | A | | 3/1976 | Brunemann | |
| 4,499,666 | A | * | 2/1985 | Smith | 33/562 |
| 4,527,337 | A | * | 7/1985 | Dreiling | 33/562 |
| 4,629,171 | A | | 12/1986 | Judy et al. | |
| 4,708,755 | A | * | 11/1987 | Lambelet | 156/64 |
| 4,712,309 | A | * | 12/1987 | Kingston et al. | 33/527 |
| 4,843,726 | A | * | 7/1989 | Ward | 33/613 |
| 4,845,858 | A | * | 7/1989 | Thomas | 33/759 |
| 4,848,049 | A | * | 7/1989 | Hanson | 52/97 |
| 4,854,096 | A | | 8/1989 | Smolik | |
| 4,858,399 | A | * | 8/1989 | Salato | 52/97 |
| 4,942,670 | A | * | 7/1990 | Brandt | 33/494 |
| 5,012,590 | A | * | 5/1991 | Wagner et al. | 33/759 |
| 5,148,890 | A | * | 9/1992 | Sipe | 182/45 |
| 5,161,345 | A | * | 11/1992 | Sobjack | 52/745.05 |
| 5,222,335 | A | | 6/1993 | Petrecca | |
| 5,394,665 | A | | 3/1995 | Johnson | |
| 5,768,793 | A | * | 6/1998 | Fields | 33/526 |
| 5,768,795 | A | * | 6/1998 | Jimenez | 33/613 |
| 5,797,233 | A | | 8/1998 | Hascall | |
| 5,809,729 | A | | 9/1998 | Mitchell | |
| 5,850,686 | A | | 12/1998 | Mertes | |
| 5,865,008 | A | | 2/1999 | Larson | |
| 5,960,554 | A | * | 10/1999 | Kamykowski | 33/562 |
| 6,052,912 | A | * | 4/2000 | May | 33/645 |
| 6,070,336 | A | * | 6/2000 | Rodgers | 33/613 |
| 6,494,014 | B1 | * | 12/2002 | Lafrance | 52/745.05 |
| 2002/0095906 | A1 | * | 7/2002 | Edmondson et al. | 52/745.05 |

* cited by examiner

*Primary Examiner*—Gregory J. Strimbu
(74) *Attorney, Agent, or Firm*—Edward L. White

(57) ABSTRACT

A construction layout stripping and method for laying out construction members or framing members at a fixed distance interval from one another. The construction layout stripping comprises: first, a pliably, non-elastic elongated base; and second, repeating units disposed on the base, the repeating units having a plurality of pairs of uprights at fixed intervals, each pair of uprights defining a partition for receiving a specified size of framing member. In a preferred embodiment, the construction layout stripping has upright defining spaces for receiving 1⅝", 3⅝", and ½" framing members on either 16" or 24" centers using the same construction layout stripping. The construction layout stripping may have cutting ribs defined thereon for cutting the stripping at a desired length.

6 Claims, 5 Drawing Sheets

CONSTRUCTION LAYOUT STRIPPING HAVING A PLURALITY OF PAIRS OF UPRIGHTS THEREON

CROSS REFERENCES TO RELATED APPLICATIONS

This application is a continuation-in-part of U.S. patent application Ser. No. 09/356,300 for Construction Layout Stripping, filed Jul. 16, 1999 now abandoned.

BACKGROUND OF THE INVENTION a. Field of the Invention

The invention relates to devices intended to ease and speed construction. In particular, the present invention is related to providing a means for laying out construction members or framing members at a fixed distance interval one from another.

b. Description of the Prior Art

In the construction industry it is necessary to place multiple construction members or framing members at a fixed interval one from another in order to create a construction element such as a wall, a roof, a sub-floor, or a truss. Traditionally, tape measures have been used to set the distances, then mark the placement of the construction member. Use of a tape measurer and a marker is time consuming and subject to mistakes. In addition, even after the construction members are placed on the mark, it can be moved or jarred easily so that it must be reset to the proper position. Great difficulty is encountered by the installer attempting to hold multiple construction members in place in preparation for permanently affixing them in position.

It is known in the prior art to provide devices for equally spacing construction members. For example, U.S. Pat. No. 5,797,233 to Hascall discloses a pre-spaced time-saving track for mounting studs for the construction of drywall or other wall surfaces. Hascall's device is intended to be used with metal studs having a c-shaped construction. The track is constructed of metal, as is a rigid c-shaped member. As specified intervals it has a pair of tabs adapted to receive the c-shaped metal studs. However, Hascall's device was not designed to work with wooden studs. In addition, it is relatively expensive. It is only capable of receiving one size of stud member. For a different sized member, a different sized track would be required. Thus, Hascall's device is only useful for metal studs for framing wall members. Other construction elements such as roofs, sub-floors, trusses, and other such elements could not be used with this particular device.

SUMMARY OF THE INVENTION

In view of the foregoing disadvantages inherent in the known types of the present invention relates to devices, it is an object of the invention to provide an apparatus which overcomes the various disadvantages of the prior art.

It is therefore an object of the present invention to provide construction layout stripping for use in fabricating and installation of construction elements. It is a further object of the present invention to provide construction layout stripping which can be used with a plurality of framing members of varying widths and thicknesses. It is a also an object of the present invention to provide construction layout stripping which could be used with metal, wood, or other construction materials.

It is a further object of the present invention to provide construction layout stripping having thereon the capability of receiving multiple sizes of construction members, and for spacing those construction members at more than one spacing interval. In an embodiment for use in wood construction, the construction layout stripping defines a set of partitions, each of which are adapted to receive 1⅝", 3⅝", or ½ construction members, and is adapted to space said members at either 16" or 24" center to center. Also, the present invention can be used with other standard spacings currently used in the construction industry or which may hereafter be developed to accommodate new materials of construction or different needs. Construction layout stripping can be scaled to all universally accepted units of measurement including, but not limited to, united standard inches and metric scaling.

It is also an object of the present invention to provide construction layout stripping having an easy means for performing a straight cut at the desired length. To this end, it is an object of the present invention to provide construction layout stripping having cutting ribs thereon at small intervals spaced along the length of the stripping for guiding a cutting device in a straight line. Further, the construction layout stripping may have projections at the edge of the base defining grooves to further ease cutting the construction layout stripping.

It is a further object of the present invention to provide construction layout stripping which can be marketed in any individual lengths or on a roll for easy use by rolling out the construction layout stripping as needed at the construction site. The construction layout stripping is then fastened in place and ready to receive construction elements. The construction layout stripping may be held in place by nails, screws, staples, glue, a self-adhesive backing or other like means. It is a further object of the present invention to provide temporary stability while affixing framing members into contact therewith.

It is also an optional object of the present invention to provide construction layout stripping having color, number, or letter coded sections corresponding the different sized frame members to be received and different spacing intervals on which whose members are to be spaced.

It is an object of the present invention to provide a method for assembling construction elements comprising the steps of providing construction layout stripping according to the present invention, placing a plurality of framing members into the partitions adapted to receive them at the desired fixed intervals, in preparation for the fixing of members in place at the desired interval. The layout of construction projects, commercial and residential, in the past took considerable time by the project's lead carpenter, and most times an additional assistant. Construction layout stripping requires only one person who does not have to be a lead carpenter or even be trained in carpentry layout procedures. With construction layout stripping, one man can perform the same task—mistake proof—in one-half the time. The actual installation time required of all framing members is also greatly reduced due to the fact the construction layout stripping's uprights hold all members in place while nailing.

It is also an object of the invention to eliminate the need for measurement and marking of locations for construction members. Construction layout stripping allows work in all kinds of weather under which construction typically takes place. Whereas previously rain, ice or other inclement weather could obscure pencil marks, construction layout stripping is not affected by the weather due to the fact that construction layout stripping will be manufactured out of water resistant materials. Adverse factors common to construction sites such as cold, heat, rain, snow, ice, dirt, sawdust, etc., will not result in construction delays as in the past with lead pencil layout markings.

Finally, it is an object of the present invention to provide construction layout stripping which can be used in the manufacturing industry. For example, where manufactured items require spacing similar elements at regular fixed intervals, construction layout stripping could easily be adapted to the needs of a manufacturing process.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent in those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

BRIEF DESCRIPTION OF THE DRAWINGS

The invention will be better understood and the objects other than those set forth above will become apparent when consideration is given to the following detailed description thereof. Such description makes reference to the annexed drawings wherein.

DETAILED DESCRIPTION OF PREFERRED EMBODIMENTS

Figure 1:
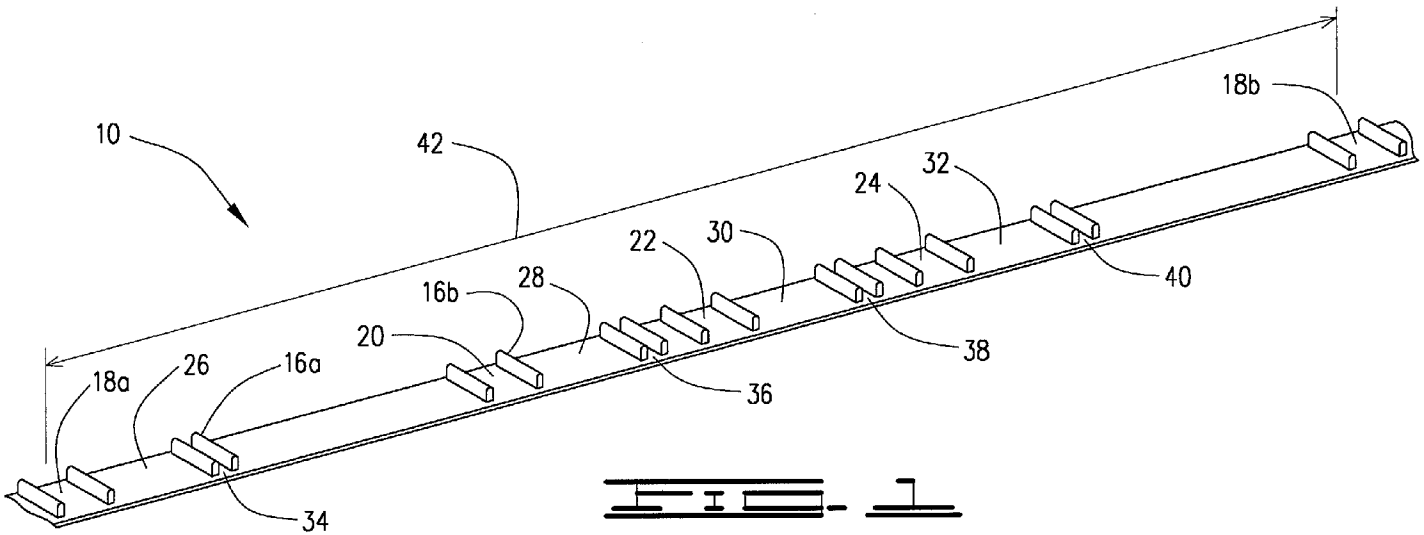
FIG. 1 is a perspective view of one embodiment of the present invention.
Figure 3:
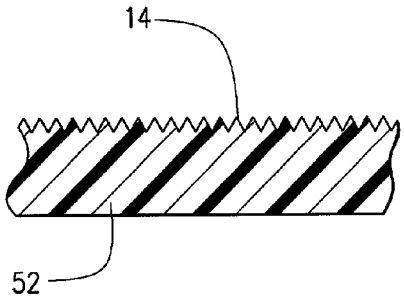
FIG. 3 is a cross sectional side view showing the cutting ribs.
Figure 4:
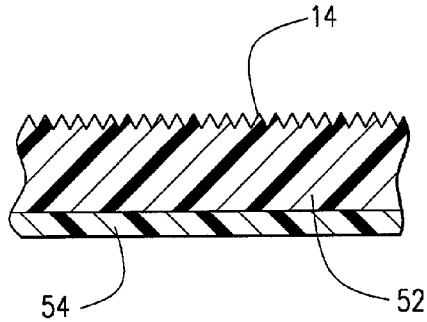
FIG. 4 is a cross sectional side view showing the cutting ribs and a two layer version of the construction layout stripping having an elastic layer and a non-elastic layer.

Referring now to the drawings, where like numerals represent like parts, the construction layout stripping 10 is generally shown in FIG. 1. It has a base 12 which is comprised of a pliable, non-elastic elongated material. The material will be as non-elastic as possible so stretching or contracting of the fixed spacing on the partitions will be insignificant. The base 12 may be constructed from fabrics of various sorts, such as cotton, nylon, rayon, silk, and the like. However, the base 12 will preferably be composed of rubber, plastic, polyvinyl chloride, polyethylene, high density polyethylene, rayon, natural rubber, or other similar materials. Where rubber or plastic materials are used, it must be kept in mind that the strip must be non-elastic. Whatever materials are chosen, they must have a relatively low coefficient of thermal expansion/contraction. That is, a material which expands or contracts significantly in response to changes in temperature is not a suitable material of construction for the present invention. Excessive expansion/contraction would alter the predetermined spacing on the construction layout stripping. The base 12 may be comprised of a single layer as shown in FIG. 3. Alternatively, the base 12 may be comprised of two layers, an elastic layer 52 and a non-elastic layer 54. For example, where it is desired to use an elastic material such as natural rubber for the base 12, a material having elasticity, a second, non-elastic layer 54, would be bonded thereto to prevent the distances between the various partitions from varying. It may be desirable to use a material having elasticity, such as rubber, because if such a material is used, an upright 16 for defining partitions 18 through 40, can be molded in the same step during which the base 12 is formed. It is even possible that the base 12 could be made out of a metallic material. Aluminum, tin, or some other metal or alloy thereof could be used, so long as it is pliable and non-elastic. Different materials of construction will be preferred for different applications. Materials of construction are not the critical issue involved in the present invention. The base 12 must simply be composed of a pliable, substantially non-elastic material.

Figure 2:
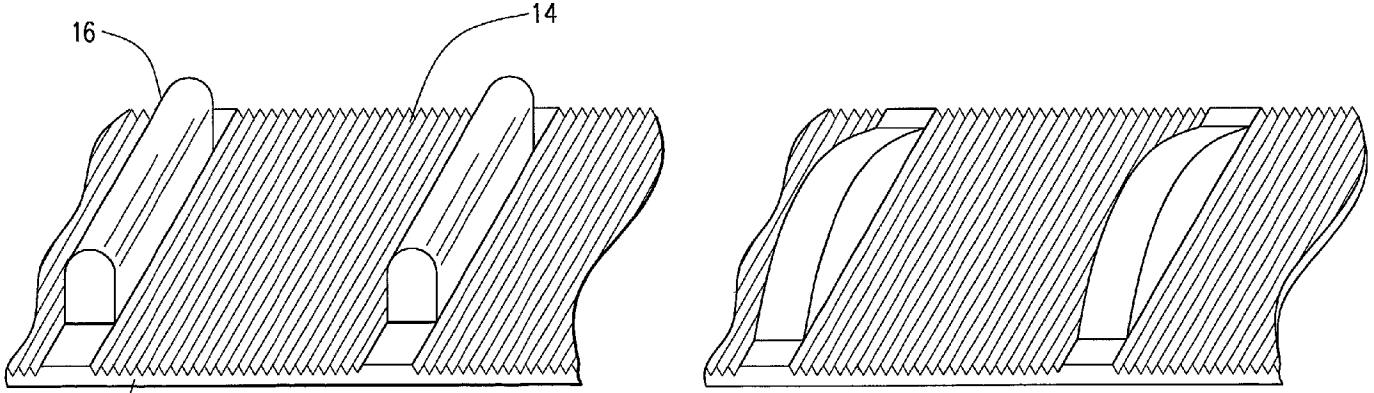
FIG. 2 is detailed view of the construction layout stripping showing the cutting ribs and the uprights.

FIG. 2 highlights cutting ribs 14 disposed along the base 12. The cutting ribs 14 provide an easy means to allow a user to make a clean cut at a desired length. A user simply runs a cutting device, such as a utility knife or a pair of snips or scissors, along the cutting rib 14 at the desired length.

FIG. 1 shows an embodiment of the present invention having repetitive units 42 with a plurality of pairs of uprights 16 on at least one predetermined fixed interval, each pair of uprights 16 is spaced for receiving a specified size of framing member. This allows construction elements to be built out of framing members spaced apart at fixed intervals without the need to measure the spacing. The members can be held in place by their placement between a pair of uprights prior to fixedly attaching the construction elements. In FIG. 1, the repetitive unit 42 is composed of the following partitions: a first 1⅝" partition 18; a second 1⅝" partition 20, having its center 16" from the first partition 18; a third 1⅝" partition 22, having its center 8" from the center of the second partition 20; a fourth 1⅝" partition 24, having its center 8" from the third partition 22; a first 3⅝" partition 26 directly adjoining the first 1⅝" partition 18, and sharing a common upright 16 therewith; a second 3⅝" partition 28, having its center 16" from the first 3⅝" partition 26; a third 3⅝" partition 30, having its center 8" from the second partition 28; a fourth 3⅝" partition 32, having its center 8" from the third partition 30; a first ½ partition 34, directly adjacent to and sharing an upright 16 with the first 3⅝" partition 26; a second ½ partition 36, having its center 16" from the first partition 34; a third ½ partition 38, having its center 8" from the second partition 36; and finally, a fourth ½ partition 40, having its center 8" from the third partition 38. The repetitive unit 42 further includes sufficient length of base to extend to the beginning of the next first 1⅝" partition 18 of the next repetitive unit. Similarly, the first 3⅝" partition 26 shares a side wall with the first ½ partition 34.

The layout shown in FIG. 1 is only one example of the types of construction members and the distances with which the present invention can be used. In steel construction, it is common to use greater spacing than in wood construction. In addition, steel members come in a wide variety of shapes and sizes. Therefore, the nature of the construction stripping for use with steel members might be dramatically different than that shown in FIG. 1. However, FIG. 1 is shown for illustrating the purposes as a typical configuration for wood construction. Similarly, a variety of spacings and construction members would be used if the present invention were to be adapted for use in manufacturing. A similar concept would be used for steel construction, though the partitions might have a different appearance.

Figure 5:
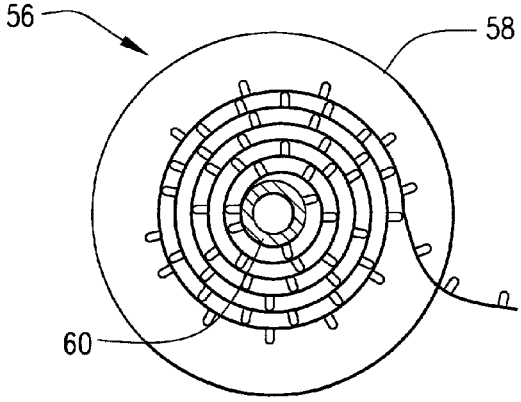
FIG. 5 is a cross sectional side view of the construction layout stripping being dispensed from a roll.
Figure 6:
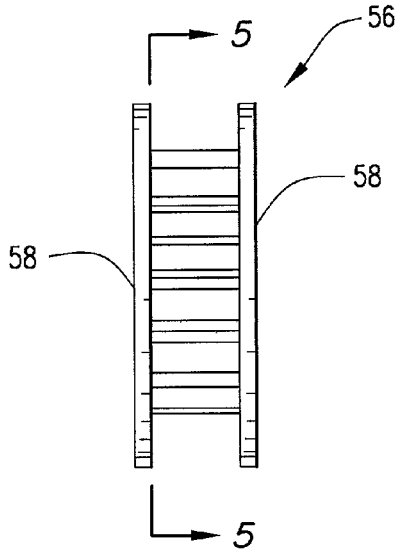
FIG. 6 is a front view of the construction layout stripping on the roll.

The construction layout stripping 10 of the present invention may be sold on a roll 56 as shown in FIGS. 5 and 6. The roll 56 has sidewalls 58 and a center 60. The construction layout stripping 10 is wound thereon to be unrolled as needed. Alternatively, the construction layout stripping 10 could be sold in individual boxed lengths. If sold in boxed lengths, the construction layout stripping would preferably be cut into sections having whole numbers of repetitive units 42 thereon. Further, the ends of the lengths would preferably have both a male end 64 and a female end 66 to ease piecing them together into longer lengths.

Figure 7:
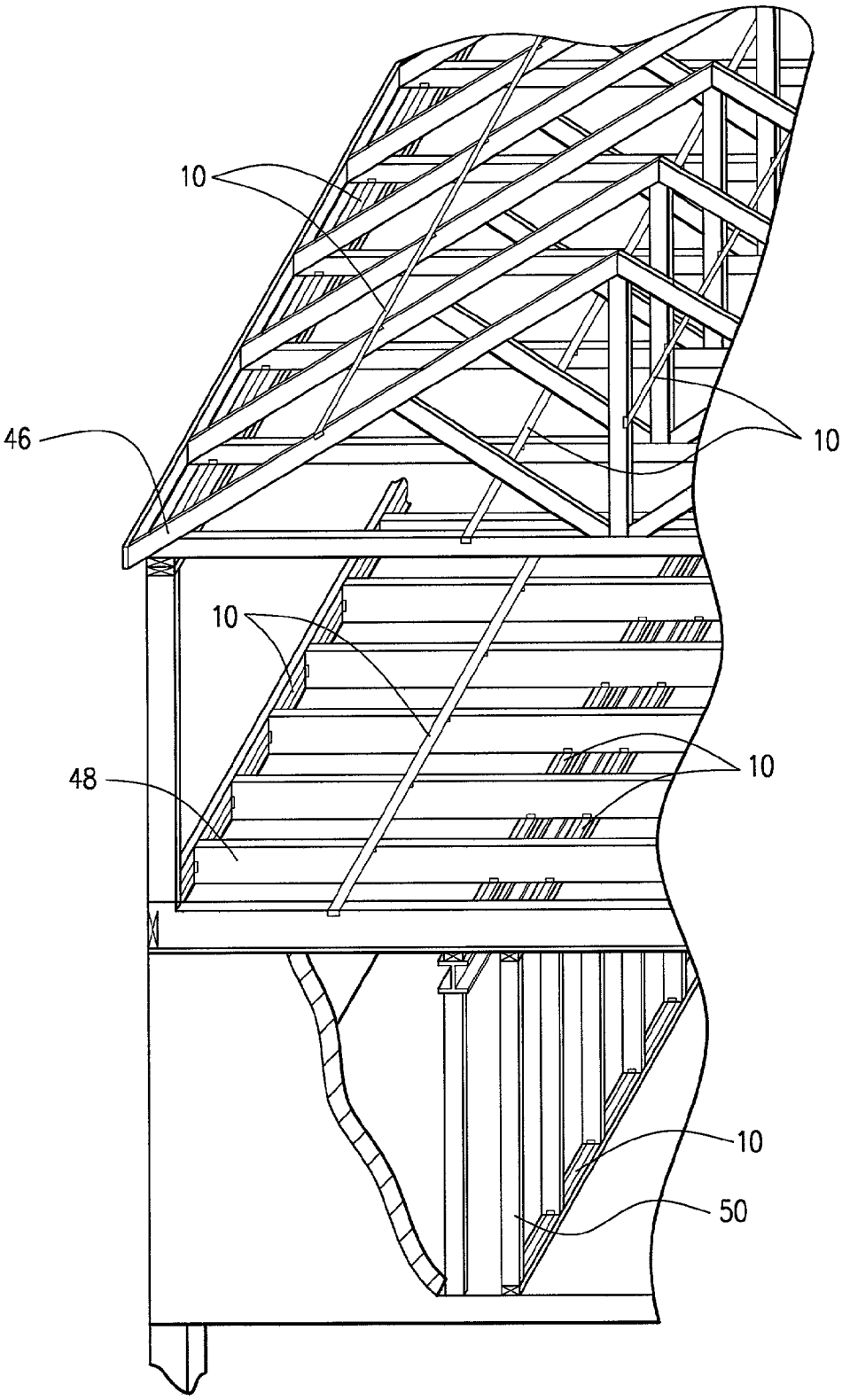
FIG. 7 is a schematic view of the present invention used in a typical structure with multiple types of construction elements.

FIG. 7 shows the construction layout stripping 10 in use on a typical structure. The construction layout stripping 10 is shown in use on roof framing members 46, sub-floor framing members 48, and wall framing members 50.

The construction layout stripping 10 may be coated with a sticky substance so that it more effectively grippingly engages framing members placed into contact therewith and/or the surface to which it is being applied. The construction layout stripping 10 may also have the uprights 16 color, number, or letter coded so that the partition associated with each size of framing member and with each spacing interval has the same color as other like numbers. For example, in FIG. 1 the uprights 16 or base 12 associated with the second 1⅝" partition 20 and the fourth 1⅝" partition 24, both of which are associated only with 16" spacing, could have the same color, for example green. The third 1⅝" partition 22, which is associated only with 24" spacing, could have a different color, for example yellow. The first 1⅝" partition 18, which is associated both with the 16" and the 24" spacing would have yet a different color, for example red. The same pattern would hold true for the set of 3⅝" partitions, 26 through 32, and for the set of ½ partitions, 34 through 40.

Figure 8:
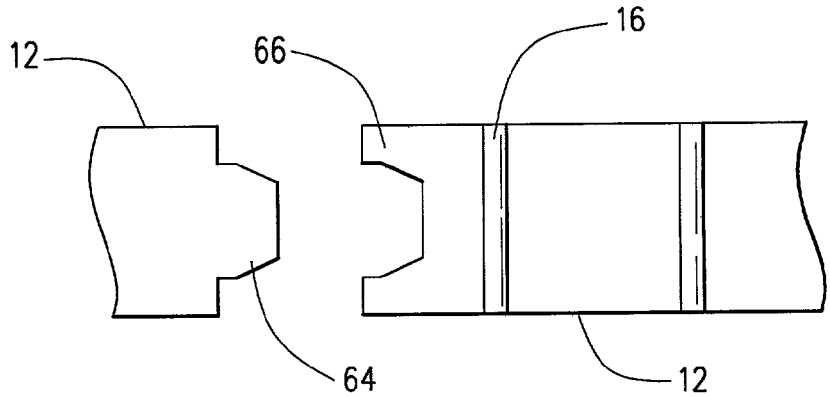
FIG. 8 is a top view of mating male and female end-pieces.

FIG. 8 illustrates a variation in a terminal point of the construction layout stripping. A male end 64 and a female end 66 are shown. The male end 64 and the female end 66 are adapted to be matingly received, one within the other, so that if the construction layout stripping is provided in fixed lengths, the units can be accurately adapted to be received within one another to maintain the appropriate spacing. The male end 64 and the female end 66 may be adapted to snap together, be welded together by glue or other suitable processes, or to be simply laid side by side then fastened in place with nails, screws, staples, or other fasteners.

Figure 9:
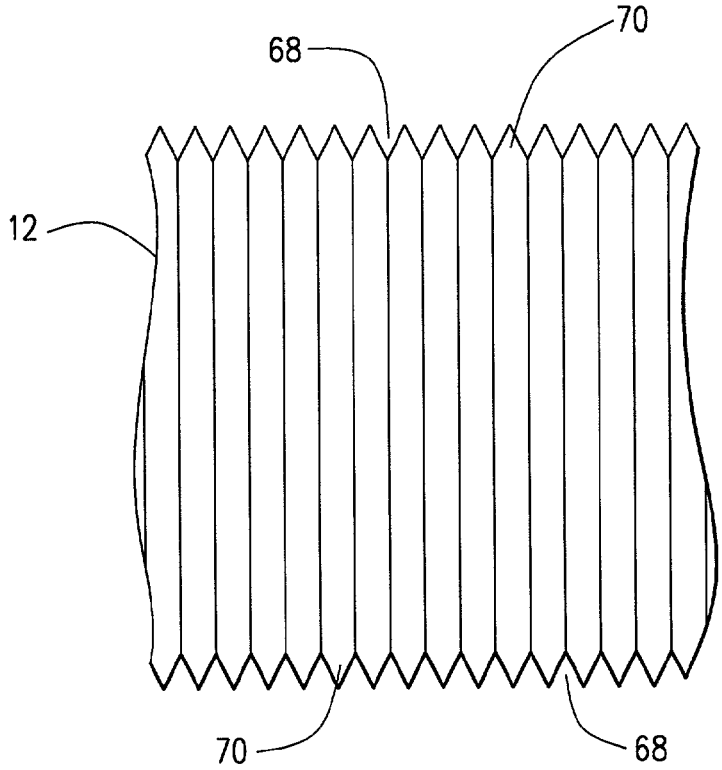
FIG. 9 is a detailed top view of the edge of the base.
Figure 10:
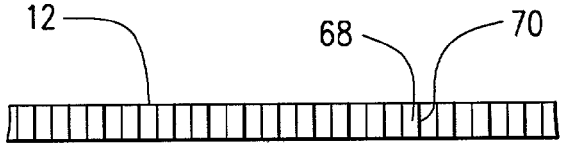
FIG. 10 is a detailed side view of the edge of the base.

FIGS. 9 and 10 illustrate one variation on the edge of the base 12. An edge groove 68 is defined by projections 70. Preferably, the edge groove 68 is spaces so as to correspond with the cutting ribs 14.

Figure 11:
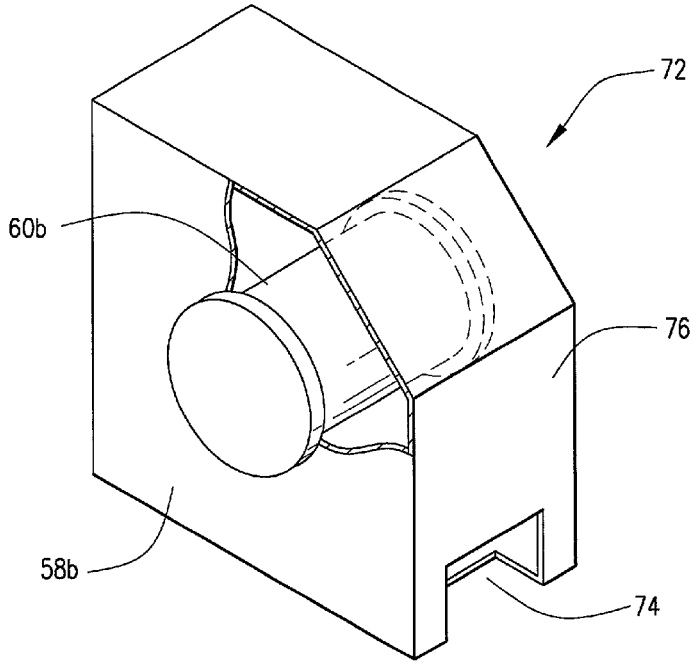
FIG. 11 is a partial cross-section perspective view of a dispenser for the construction layout stripping.

FIG. 11 shows a box 72 adapted to receive the construction layout stripping 10. The box is comprised of side walls **58*b*, a center 60, which is essentially a tube adapted to receive the construction layout stripping 10 and enclosed sides 76 defining an opening 74 there through, through which the construction layout stripping 10 can pass. It is believed that a box 72 having the dimensions of 14"×14"×4" wide would be appropriately sized to receive approximately 100' of construction layout stripping 10 if the center 60*b* is approximately 4" in diameter. Preferably, the construction layout stripping will be attached to a cylinder which rotates about a shaft, which is the center 60*b*. This allows the construction layout stripping 10** to be more easily dispensed.

Figure 12:
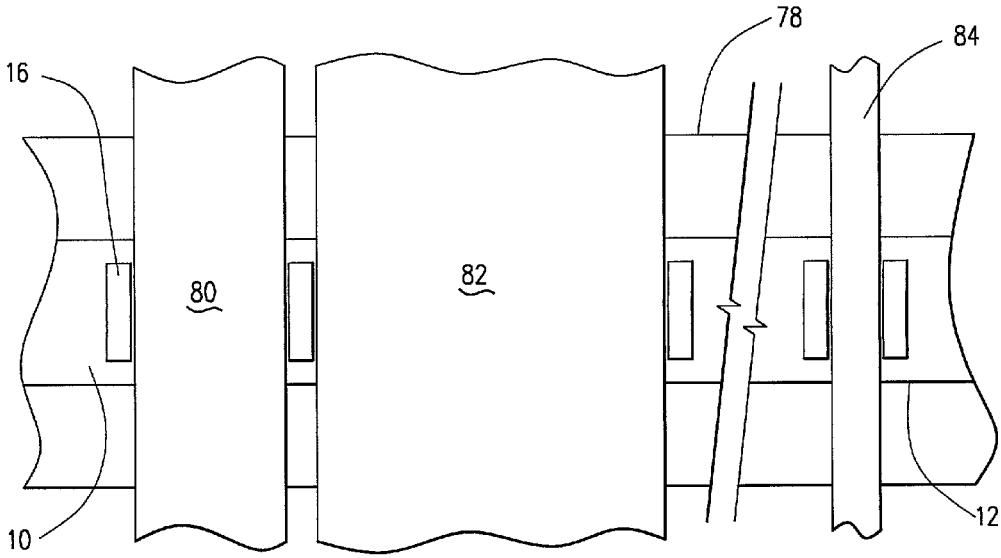
FIG. 12 is a top view of various sizes of framing members received in the construction layout stripping.

FIG. 12 shows several framing members placed on the construction layout stripping 10. As shown, the members are laying length-wise on the stripping. However, it should be understood that the framing members could also be standing upright. Also, note that each piece of construction layout stripping 10 will ordinarily receive only one type of construction member in the field, rather than the three different sizes shown in FIG. 12.

OPERATION OF APPARATUS

In operation, a user lays out the needed amount of construction layout stripping, affixes it in place with sticky tape, staples, nails, screws, etc., then places the desired members along the desired spacing thereon. The user can then permanently fasten the members into place as needed. Pairs of uprights 16 hold the members in the partitions 18 through 40 until they are fastened. This eliminates the need to re-adjust the spacing of the members and eliminates human mis-measuring mistakes.

Having thus described the field of the invention, the prior art, the attached drawings, the summary of the invention, and the detailed description of the preferred embodiments, I claim:

1. A construction layout strip comprising:

a. a pliable, non-elastic base, b. a plurality of uprights extending generally perpendicularly to said base, said uprights defining a first group of said uprights and a second group of said uprights, c. said first group of said uprights comprising a first plurality of pairs of said uprights, i. each of said first plurality of pairs of said uprights comprising a first said upright and a second said upright defining a center therebetween, said second said upright spaced 1⅝" from said first said upright with no said uprights therebetween for receiving a 1⅝" framing member therebetween, ii. said center of each of said first plurality of pairs of said uprights being spaced 8" from said center of at least one adjacent said first plurality of pairs of said uprights, d. said second group of said uprights comprising a second plurality of pairs of said uprights, i. each of said second plurality of pairs of said uprights comprising a third said upright and a fourth said upright defining a center therebetween, said third said upright spaced 3⅝" from said fourth said upright with no said uprights therebetween for receiving a 3⅝" framing member therebetween, ii. said center of each of said second plurality of pairs of said uprights being spaced 16" from said center of at least one adjacent said second plurality of pairs of said uprights.

2. The strip of claim 1 further comprising the base having cutting ribs defined thereon that enable user to make a cut at a desired length with a blade cutting device.

3. The strip of claim 1 where the base is comprised of, an elastic layer and a non-elastic layer, bonded together, whereby the elastic layer provides for grippingly engaging the framing members and the non-elastic layer provides support so that the strip resists stretching.

4. The strip of claim 1, the base having a first sticky surface for more securely grippingly engaging the framing members.

5. The strip of claim 4, the base having a second sticky surface on an opposite side from the first sticky surface for grippingly engaging a surface to which the strip is being applied.

6. The strip of claim 1 further comprising a third group of said uprights comprising a third plurality of pairs of said uprights, each of said third plurality of pairs of said uprights comprising a fifth said upright and a sixth said upright defining a center therebetween, said fifth said upright spaced ½" from said sixth said upright with no said uprights therebetween for receiving a ½" framing member therebetween, said center of each of said third plurality of pairs of said uprights being spaced 16" from said center of at least one adjacent said third plurality of pairs of said uprights.

* * * * *